United States Patent [19]

Owen et al.

[11] 4,384,613

[45] May 24, 1983

[54] METHOD OF IN-SITU RETORTING OF CARBONACEOUS MATERIAL FOR RECOVERY OF ORGANIC LIQUIDS AND GASES

[75] Inventors: Lawrence B. Owen; John F. Schatz; Usman Ahmed, all of Salt Lake City, Utah

[73] Assignee: Terra Tek, Inc., Salt Lake City, Utah

[21] Appl. No.: 200,320

[22] Filed: Oct. 24, 1980

[51] Int. Cl.[3] ..... E21B 43/243; E21C 41/10

[52] U.S. Cl. ..... 166/256; 166/245; 166/272; 299/2

[58] Field of Search ..... 166/245, 256, 259, 263, 166/266, 268, 272, 302, 50; 299/2

[56] References Cited

U.S. PATENT DOCUMENTS

| | | | |
|---|---|---|---|
| 2,974,937 | 3/1961 | Kiel | 166/272 X |
| 3,017,168 | 1/1962 | Carr | 166/256 X |
| 3,062,282 | 11/1962 | Schleicher | 166/272 X |
| 3,250,327 | 5/1966 | Crider | 166/256 X |
| 3,283,814 | 11/1966 | Schlight et al. | 166/259 X |
| 3,284,281 | 11/1966 | Thomas | 166/272 X |
| 3,441,083 | 4/1969 | Fitzgerald | 166/272 X |
| 3,960,213 | 6/1976 | Striegler | 166/272 |
| 3,982,592 | 9/1976 | Hamrick et al. | 166/302 |
| 3,994,340 | 11/1976 | Anderson et al. | 166/272 |
| 4,124,071 | 11/1978 | Allen | 166/272 X |

FOREIGN PATENT DOCUMENTS

| | | | |
|---|---|---|---|
| 643416 | 6/1962 | Canada | 166/256 |
| 123138 | of 1948 | Sweden | 166/256 |

*Primary Examiner*—Stephen J. Novosad

*Assistant Examiner*—George A. Suchfield

*Attorney, Agent, or Firm*—M. Reid Russell

[57] ABSTRACT

The method of the present invention involves a two-phase process for in-situ retorting and recovery of carbonaceous material contained within typical subterranean tar sand formations, and includes formation of conventional arrays of in-seam ducts, and positioning heating devices to heat a section of the formation over a large extent thereof. The operation of the heating devices in the first phase is controlled to provide heat into the formation without burning of the carbonaceous material therein, resulting in development of a quasi-stable zone of pyrolysis about the heating duct, to thermally crack the carbonaceous material producing various organic liquid oil fractions and derived condensible vapors and non-condensible gases. The products produced thereby are then withdrawn through a suitable array of collection wells. In the second phase of the process a residual coke layer that will have formed as a result of the pyrolysis of the carbonaceous material is burned by introducing a combustion-supporting gas, such as air or oxygen, into the hot sand-coke blanket preferrably via the line source heating ducts spontaneously igniting the coke to produce a temperature elevation in the zone of pyrolysis to both crack the proximate carbonaceous material and to burn away the coke layer from around the shut-in collection wells freeing them to continue withdrawal of the products of the cracking process. After combustion of the basal sand-coke blanket air flow to the tar sand formation will be terminated and the heater operation restored, repeating the process.

11 Claims, 7 Drawing Figures

METHOD OF IN-SITU RETORTING OF CARBONACEOUS MATERIAL FOR RECOVERY OF ORGANIC LIQUIDS AND GASES

BACKGROUND OF THE INVENTION

1. Field

The method of the present invention relates to processes for in-situ retorting of tar sand formations and the simultaneous recovery of liquid and gaseous by-products. Tar sand refers to a consolidated or unconsolidated sedimentary rock in which the available pore space is filled to a varying extent with a viscous, semi-solid tar or bitumen.

2. State of the Art

The huge deposits of tar sands in the Western United States and Canada have stimulated activity by industry to devise practical and economical methods of recovery. Of the total reserves of tar sands in the United States (>28 billion barrels) and Canada, (>1300 billion barrels) less than fifteen percent (15%) are amenable to surface recovery. Therefore, the method of the present invention addresses the need for effective and cost-efficient in-situ processes for recovery of the major portions of these deposits.

Where in-situ recovery of gaseous and liquid products from tar sand formations have been heretofore described in the literature and U.S. patents, such processes have all involved penetration of the target formation by drilled vertical wellbores which are arranged in a suitable fashion and have generally included initiation of combusion of the carbonaceous material itself to provide for recovery of the retorting by-products. Examples of such former processes are shown in U.S. Pat. No. 2,584,605, issued Feb. 5, 1952, to E. S. Merriam, et al.; U.S. Pat. No. 2,718,263, issued Sept. 20, 1955, to W. O. Heilman, et al.; U.S. Pat. No. 2,874,777, issued Feb. 24, 1959, to H. J. Tadema; U.S. Pat. No. 2,994,374, issued Aug. 1, 1961, to F. W. Crawford, et al.; U.S. Pat. No. 3,087,541, issued Apr. 30, 1963, to E. R. Elzinga; U.S. Pat. No. 3,126,954, issued Mar. 31, 1964 to F. E. Campion, and all show injection of a gas, such as air or oxygen, via a vertical shaft or drillhole as an essential factor in sustaining combustion of the carbonaceous material. Another, U.S. Pat. No. 2,801,089, issued July 30, 1957, to J. W. Scott, Jr., calls for injection of a combustible gas mixture, that includes air or oxygen, via vertical boreholes or shafts or boreholes located at the bottom of the target formation, and so is also unlike the present invention.

Other earlier art that involves tar sand heating including U.S. Pat. No. 3,048,221, issued Aug. 7, 1962, to M. R. Tek, have required generation of vertical and horizontal fractures that intersect vertical production and injection wells, with combustion of carbonaceous material supported by injection of air via injection wells. This art also teaches recovery of retorted by-products by an enhanced formation permeability as provided by the artificially generated fractures. Another, U.S. Pat. No. 3,263,750, issued Aug. 2, 1966, to W. C. Hardy, teaches that retorting efficiency of tar sand formations and subsequent recovery of by-products may be significantly enhanced by injecting, via vertical wellbores, slugs of low viscosity oil with tailored boiling points such that subsequent heating of the formation, via vertical injection wells, and maintenance of combustion by injection of air, to preclude formation of oil blocks in the tar sand formation. Also, U.S. Pat. No. 2,914,309, issued Nov. 24, 1959, to G. J. W. Salomonsson, teaches uniform heating of a tar sand formation by use of moveable heaters suspended in vertical wellbores. This patent claims that the efficiency of a retorting process is enhanced by injection of air, via vertical wellbores, to sustain combustion of a portion of the carbonaceous material contained within a target formation.

All the above-cited processes for in-situ retorting of tar sand formations require that a burn front move through the formation. Therefore, they all suffer from the common deficiency of failing to insure that air, oxygen or other gases, required to drive the process by supporting combusion of the carbonaceous material contained within the formation, are uniformly distributed within the formation and are therefore unlike the process of the present invention.

The two-stage process disclosed in the present invention represents a significant departure from prior art within our knowledge and is a significant departure from that taught in the public domain technical literature pertaining to so-called mine assisted in-situ processing (MAISP) that have as an objective to thermally mobilize bitumen using horizontal subterranean tunnels as heating conduits. Such art includes the arrangement of a U.S. Pat. No. 4,196,814, issued Aug. 15, 1978, to G. B. French, and is as detailed in a technical paper presented to a 13th Canadian Rock Mechanics Symposium in Toronto, Canada, held May 28 and 29, 1980, by D. W. Develny and J. M. Raisbeck, entitled "Rock Mechanics Considerations for In-Situ Development of Oil Sands". Rather, unlike prior processes, the present invention provides for heating via stationary line sources within the formation so as to provide a convective heat transfer system that is maintained by generation of volatiles derived from the pyrolysis of mobilized bitumen adjacent to the line source heaters. The pyrolysis zone, produced by operation of stationary line source heaters, is quasi-stationary, where as in other in-situ retorting processes, a burn front, and pyrolysis zone, are propagated through the tar sand formation. Establishment of a forced convective heat transfer system leads to further reduction of the viscosity of the hot mobilized bitumen by the solvent action of convecting thermally cracked low viscosity oils and their condensible vapors and creation and continual growth, both laterally and upward, of a high permeability zone of sand-coke. Recovery of liquid and gaseous retorting by-products so produced is preferably accomplished via an array of designated vertical boreholes.

The high permeability zone of sand-coke that builds up in the thermal cracking process is then utilized as a heat source in a second stage process of the present invention where air-supported combustion thereof is accomplished by air injection via the line source heating duct. That air injection provides a significant economic incentive with respect to diminished energy requirements for continuous operation of line source heaters and is controlled to just burn the sand-coke zone whereupon the air injection is discontinued and heating at the stationary line source is resumed.

In other in-situ processes, unlike that of the present invention, the efficiency of thermal cracking of tar is relatively low due to the inability to control the flow of air or oxygen to the combustion zone and the inability to control combustion kinetics of the virgin bitumen. With the present invention, bitumen which passes into the zone of pyrolysis, as defined by the appropriate temperature-pressure relationship and specific characteristics of the bitumen, is converted to thermally cracked by-products with an efficiency of greater than ninety percent (90%).

SUMMARY OF THE INVENTION

It is, therefore, a general object of the present invention to provide a method for efficiently retorting a carbonaceous material contained within a typical tar sand formation, in place, without requiring that a significant portion of the carbonaceous material be combusted, while simultaneously recovering the liquid and gaseous by-products.

It is, therefore, an additional object of the present invention to provide for heating of the carbonaceous material without requiring burning thereof.

It is an additional object of the present invention to provide for retorting of the carbonaceous material by forming horizontal to inclined in-seam ducts within the basal section of a tar sand formation and burning a hydrocarbon fuel, or circulating hot gas or operating electric heaters therein to thermally crack the formation producing liquid and gaseous by-products therefrom.

It is an additional object of the present invention to provide, for retorting of a carbonaceous material contained within a typical tar sand formation, a two stage process where, without burning of the originally in-place carbonaceous material, heat is introduced to develop a quasi-stable zone of pyrolysis to thermally crack from the formation various organic liquid oil fractions and derived condensible vapor and non-condensible gases, creating a sand-coke layer that is then burned, further cracking hydrocarbons from the formation by a controlled introduction of air or oxygen gas therein until the coke layer is fully combusted.

It is an additional object of the present invention to provide for utilization of non-condensible gases produced in the cracking process as heating gas for burning in the carbonaceous material along with the hydrocarbon feedstock.

Retorts are formed in the tar sand formation by emplacing conventional horizontal to inclined, in-seam ducts within the basal section thereof. These ducts are subsequently fitted with heaters such that each duct represents a line source heater. The ducts may be emplaced by a variety of conventional techniques including, but not limited to, downdip drilling from benches cut along outcrops, drilling or mining of vertical large diameter shafts and subsequent mining or drilling of radially distributed, horizontal to near horizontal drifts or completion of directionally drilled holes initiated from common drill pads.

Thereafter, an array of deep vertical wellbores is interspersed above the heating ducts in patterns selected to lead to the efficient recovery of liquid and gaseous by-products of the in-situ retorting process of the present invention. Preferably, wells are completed adjacent to the line source heaters over a vertical distance corresponding to, preferably, the lower one-third ($\frac{1}{3}$) of the total tar sand formation apparent thickness to produce a product that is enriched primarily in thermally cracked oil and condensible vapors and also a lesser amount of noncondensible gases and uncracked, thermally mobilized bitumen. Also, additional vertical wells are preferably completed over the upper one-third ($\frac{1}{3}$) of the total tar sand formation apparent thickness, interspersed with the other collection wells in an optimal pattern to produce a product that is then enriched in relatively cool, non-condensible gases. Such non-condensible gases produced as by-products of the in-situ retorting, following appropriate treatment as required on the surface, are then available, by virtue of their content of combustible gases, as a source of heating gas. The liquid fraction and condensible gases produced as by-products of the in-situ retorting, following appropriate treatment, as required at the surface, are available, by virtue of their hydrocarbon content, for conventional applications which require liquid hydrocarbon feedstock, fuel or lubricants.

Unique to the present invention is the heat application to the formation via stationary, horizontal to near horizontal, or inclined in-seam line sources, that preferably are arranged parallel to the formation bedding planes such that heat transfer within the formation is accomplished by the formation of, and action of, forced convective cells driven by non-condensible gases, water vapor and thermally cracked organic liquids and condensible gases. Heat transfer to virgin bitumen is accomplished primarily by conduction as the hot gases and liquids, which constitute a portion of the convection cells, move through the tar sand formation. Passage of mobilized bitumen through a quasi-stable pyrolysis interface defined by the appropriate pressure dependent isothermal surface results in thermal cracking of the bitumen and generates a sand-coke mixture, with higher permeability to gases and liquids than possessed by the virgin tar sand formation. The sand-coke blanket continually expands laterally and upward toward the top of the tar sand formation. Hence, as the in-situ process described in this invention progresses, the heat transfer efficiency of the forced convective cells continually improves.

As a second phase of the present invention, air or oxygen is provided into a sand-coke blanket built in response to the establishment of a forced convective heat transfer system and migration of bitumen into a zone of pyrolysis distributed about the line source heaters to support heating thereof. Ignition of the coke blanket by exposing it to a stream of oxygen-containing gas, such as air, can be accomplished in order to favorably impact process economics, with the air injected via in-seam line sources. The injected air stream follows paths previously followed by volatiles formed during the initial stages of the process when the line source heaters were in use. Burning of the coke provides a subsidiary source of heat energy to continue driving the forced convective heat transfer system, and therefore complete ignition of the coke buildup is not required.

The pattern of by-product deep collection wells established over the array of line source heaters is such that breakthrough of injected air to any collection well can be immediately detected and, as a result, air flow to the heating ducts immediately adjacent to such collection well may be reduced or terminated as conditions warrant. Therefore, the air injection process to burn the sand-coke blanket can be controlled and continuously monitored to avoid air-supported combustion of virgin bitumen.

Phase-two processing is terminated by discontinuing air injection, and phase-one processing reinitiated by a resumption of operation of the line source heaters contained within the ducts and by resuming operation of by-product deep collection wells completed adjacent to the line source heating shafts. The pressure gradients imposed by operation of the deep collection wells completed adjacent to the line source heaters will lead to rapid resumption of the phase-one forced-convective heat transfer system.

The overall two-stage described process of the present invention is repeated as necessary to accomplish conversion of virgin bitumen to thermally cracked by-products with high efficiency and to simultaneously recover thermally cracked by-products with high efficiency.

THE DRAWINGS

These and other aspects of the invention will be fully understood by referring to the following description and the accompanying drawings that show:

Figure 4:
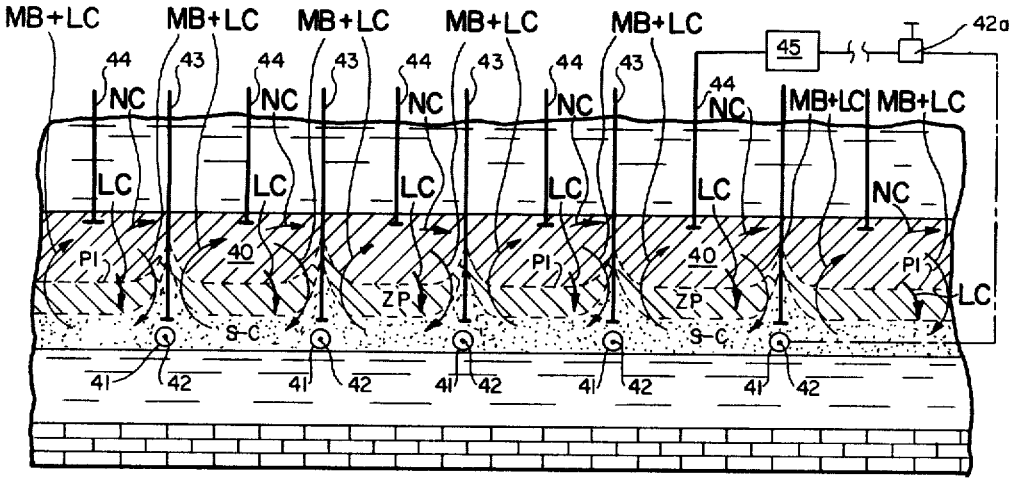
FIG. 4 is a schematic cross-sectional view taken parallel to the strike of a tar sand formation, showing the distribution of retort by-product collection wells and showing, with arrows, the flow of the forced convective heat transfer system to thermally crack in Phase I of the invention the virgin bitumen.
Figure 6:
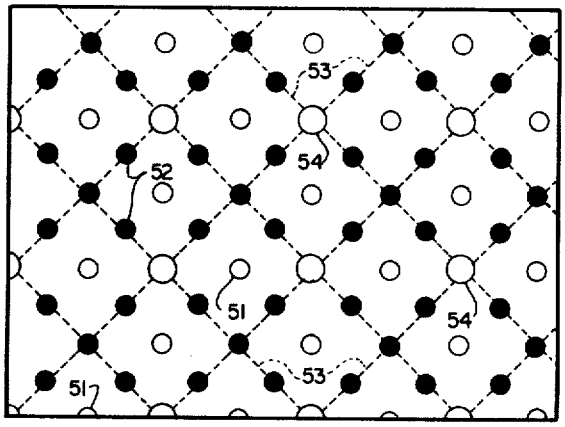
Figure 7:
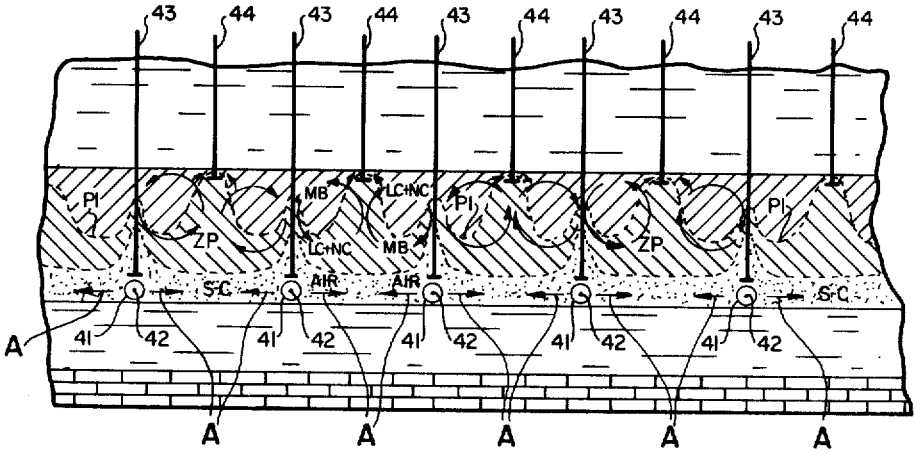

FIG. 6 is a top plan view of a radial distribution of heating ducts, shown in broken lines, and their relationship to the array of retort by-product collection wells; and FIG. 7 is a schematic cross-sectional view like that of FIG. 4, only illustrating with receding broken lines how a hot sand-coke blanket may be ignited by contact with a combustion-supporting gas in Phase II of the invention to provide heat to assist in maintaining the forced convective heat transfer system.

DETAILED DESCRIPTION

With reference to the drawings, the present invention involves a two-stage method for the in-situ retorting of tar sand and provides for a simultaneous collection of the by-product hydrocarbon liquids and gases of that retorting process.

Figure 1:
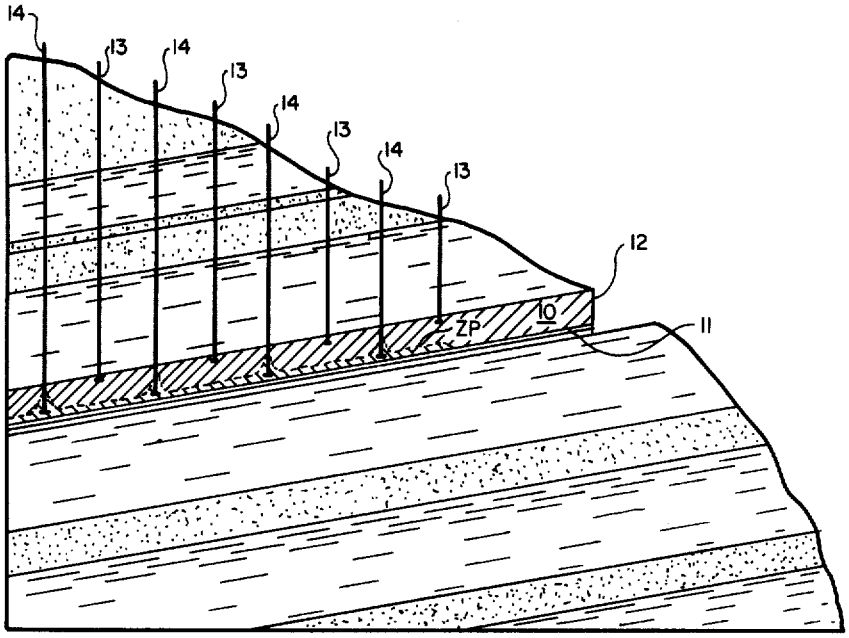
FIG. 1 is a schematic cross-sectional view showing construction of an in-situ retort in a tar sand formation including installation of an in-seam line source heating duct parallel to the dip of the formation, from a bench cut in an outcrop, and showing an array of retort by-product collection wells and showing with broken lines, a zone of pyrolysis.
Figure 2:
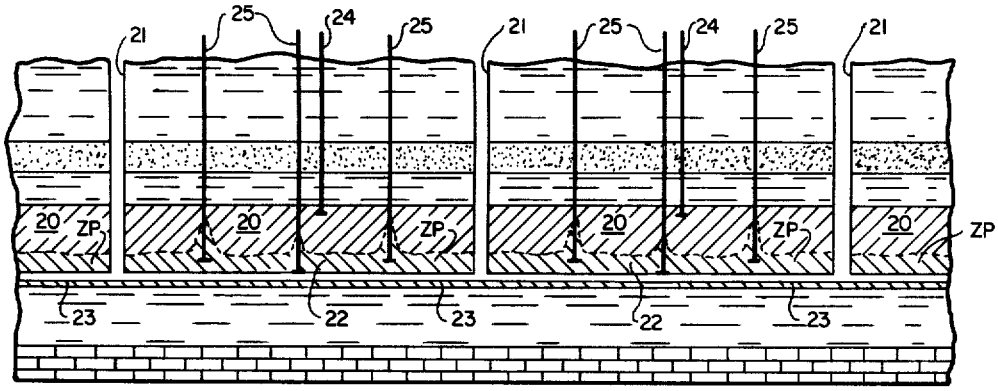
FIG. 2 is a schematic cross-sectional view showing an in-situ retort system constructed in a tar sand formation by installation of vertical shafts and radially distributed in-seam drifts therefrom.
Figure 3:
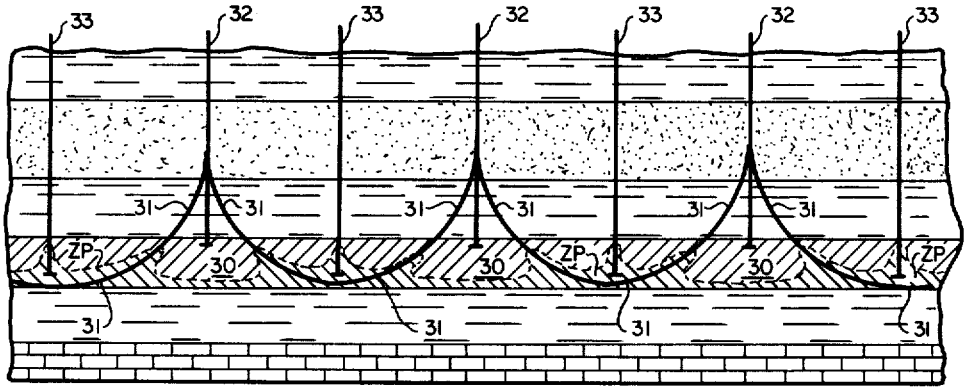
FIG. 3 is a schematic cross-sectional view showing an in-situ retort constructed in a tar sand formation by installation of directional drilled wellbores from a central drilling pad.

FIGS. 1 through 3 illustrate, in schematic, the formation in a subterranean tar sand formation of conventional near horizontal or inclined, in-seam, stationary line source heating arrays. FIG. 1 illustrates construction of heating ducts by conventional horizontal drilling or mining techniques in a tar sand formation 10 when the heating ducts 11 are run downdip from benches cut 12 in accessible outcrops. FIG. 2 illustrates vertical drilled, larged bore shafts 21, hereinafter referred to as vertical shaft, that are run to the basal section 22 of a tar sand formation 20 with radially distributed horizontal or dipping drifts or ducts 23 developed from the vertical shaft 21, by means of conventional horizontal drilling or mining techniques. FIG. 3 illustrates an arrangement of radially distributed horizontal or inclined in-seam heating ducts 31 that can be bored, utilizing conventional directional drilling techniques from a single drilling pad into a tar sand formation 30.

The in-situ retorting process of the present invention is accomplished in Phase I by supplying heat to the tar sand formation by burning of a combustible material in the heating ducts 11, 23 and 31. The actual mode of formation heating can utilize any one of several conventional options including, but not limited to, the placement of gas burners, for the ignition of a combustible gas-air mixture, within the heating ducts, or emplacement of electrical heaters within the heating ducts or passage of hot gas through the heating ducts, or the like.

Illustrated also in FIGS. 1, 2 and 3, are, respectively, shallow vertical well bores 13, 24 and 32 and deep vertical well bores 14, 25 and 33. As will be explained hereinafter, the shallow well bores to recover non-condensible gases and other by-products, and the deep well bores to recover organic liquids, condensible gases and other by-products.

FIG. 4 is included to illustrate the technical aspects of the present method in relationship to the actual in-situ retorting of carbonaceous material. FIG. 4 shows, in sectional view, a tar sand formation 40 wherein are arranged heating ducts 41 containing heaters 42. Heaters 42, as described above, can consist of burners arranged to burn a combustible air-gas mixture, can be electric heaters, can be arrangements for passing hot gas, or the like, within the scope of this disclosure. Heat so supplied to the heating ducts 41 passes into the formation 40 and causes thermal cracking of virgin bitumen in the tar sand formation immediately adjacent to the heating ducts 41. The retorting process causes production of lighter weight organic liquids, condensible and non-condensible gases and water vapor.

In practicing the method of the present invention, it is the upward migration of the products of hot thermal cracking of bitumen along with water vapor that is the primary mode of heat transport. Intimate contact between virgin bitumen and hot gases and liquids plus partial mixing of hot gas and liquids with virgin bitumen will cause the bitumen to undergo a viscosity decrease, that results in mobilization of virgin bitumen at the face of a pyrolysis zone, as defined below, and as illustrated in broken lines in FIGS. 1 through 4 and identified as "ZP". The net direction of movement of the bitumen is downward under the influence of gravity as shown by arrows labeled MB+LC in FIG. 4. The "MB" represents mobilized bitumen and the "LC" represents liquids and condensible gases. The liquid and condensible hydrocarbons, derived from the thermal cracking of bitumen eventually cook, become more dense, and begin to settle under the influence of gravity, shown in FIG. 4 as arrow LC. Water vapor also condenses and beings to settle under the influence of gravity. The non-condensible gases derived from the thermal cracking of bitumen, shown in FIG. 4 as arrow NC, the "NC" representing non-condensible gases, collect along the upper portions of the tar sand formation and begin to form a gas cap. The forced convective heat transfer system is completed as mobilized bitumen and cooled water, and organic liquids flow downward and pass through the pyrolysis interface, PI, into the zone of pyrolysis where rapid reheating occurs, as illustrated by the arrows labeled MB+LC and LC in FIG. 4. In operation, withdrawal of the mobilized bitumen liquids and condensible gases is through deep well bores 43, with non-condensible gases withdrawn through shallow well bores 44, as shown in FIG. 4. Also, the shallow well bores 44 are preferably connected, as appropriate, after cleaning, and filtering as illustrated by a box 45, to supply make-up gas for burning in heaters 42, which connection is illustrated as a valve 42*a*.

The pyrolysis interface shown in broken lines as ZP in FIG. 4, is defined by the minimum isothermal surface required to produce a significant degree of thermal cracking of virgin bitumen. For typical tar sands, temperatures between 400 to 650 degrees centigrade would be required to insure nearly complete conversion of bitumen to coke plus distilled products. The actual temperature requirement in any particular case required to insure high conversion efficiency is a function of the depth-pressure environment, water content, heating times, and the chemical properties of the specific bitumen. As temperatures increase uniformly along any path as the pyrolysis interface is passed and the radial distance to the heating shafts diminishes, it is not a requirement that the entire thickness of the tar sand formation be elevated to the pyrolysis temperature. Rather, all that is required is that a zone of pyrolysis be established and that mobilized bitumen migrates from distal portions of the tar sand formation into the zone of pyrolysis.

Figure 5:
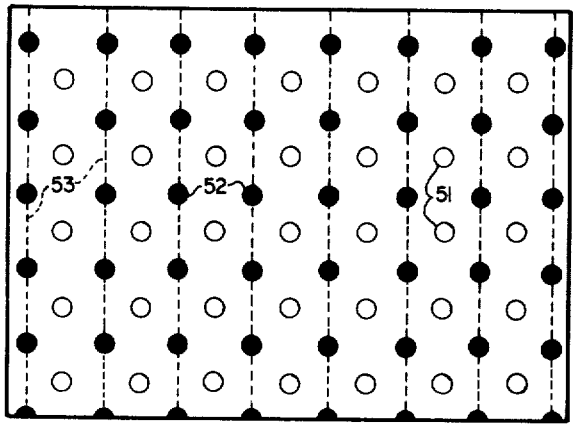
FIG. 5 is a top plan view of a linear distribution of heating ducts shown in broken lines, and their relationship to the array of retort by-product collection wells.

To recover the products of the above-described retorting process of Phase I, an array of vertical wellbores is completed above the heating ducts, as shown in FIGS. 1 through 4, for collection, as described, of the by-products of the in-situ retorting process. Such collection well array, as illustrated in FIGS. 5 and 6, consist, as described, of two groups of wells distinguished by the depth interval over which they are completed. As detailed hereinabove, one set of wells is completed within the upper one-third ($\frac{1}{3}$) of the apparent thickness of the tar sand formation, identified as shallow wells 51 in FIGS. 5 and 6. These shallow wells are used, during Phase I of the process, to collect a product primarily enriched in non-condensible gases and can, as shown in FIG. 4, be connected appropriately to supply make-up gas for combustion in heaters 42. A further function of these wells is to control gas pressures in the upper portions of the tar sand formation so as to preclude environmentally damaging releases of non-condensible gases. During Phase II of the process, as will be described later herein, these wells collect by-products that are enriched in bitumen-pyrolysis distillates.

A second set of by-product collection wells, identified as deep wells 52 in FIGS. 5 and 6, are completed within the lower one-third ($\frac{1}{3}$) of the apparent thickness of the tar sand formation. These wells collect a retort by-product that is primarily enriched in bitumen distillates, during Phase I of the process. These wells, as will be described, are shut-in during Phase II of the process. Preferably, deep wells 52 are located, as shown also in FIGS. 5 and 6, adjacent to the line source heaters in ducts 53, identified by broken lines, which ducts can be formed as shown in FIG. 5 by directional drilling techniques as illustrated in FIG. 3 or boring into a bench cut as illustrated in FIG. 1. In FIG. 6, vertical shafts are shown to indicate that the ducts 53 radiating therefrom are preferably formed, as illustrated in FIG. 2, as large bore shafts.

The total array of retort by-product collection wells, in addition to serving the function of transferring organic by-products of the in-situ retorting process to the surface, also provide a significant driving force, in the form of pressure gradients, that contribute to the establishment and stability of forced convective heat transfer cells.

During Phase I of the present invention a carbon residue of sand-coke will be formed as a by-product of the thermal retorting of the bitumen, which coke will have a relatively high permeability to gases and liquids. In the process of pyrolyzing bitumen, as described above, therefore, a high permeability sand-coke blanket consisting of residual carbon-rich particles dispersed within the original formation matrix material will be continually formed. The sand-coke blanket, in the process of its formation, will grow continuously laterally and upwardly toward the top of the tar sand formation. Such occurrence of high permeability sand-coke will provide for a continuing enhancement in the ease of passage of liquids and gases and thereby continuously contributes to an enhancement in the effectiveness and stability of the described forced convective heat transfer cells. The described sand-coke blanket is formed without the need for combusting bitumen by forced passage of a combustion-supporting gas such as air or oxygen, and therefore, the spatial distribution of the sand-coke layer will be controlled by the formation and spatial distribution of the convection cells and not by permeability discontinuities within the virgin tar sand formation that could significantly influence the initial combustion of bitumen when such combustion has been supported by air or oxygen injection. Since the mobilized bitumen is forced to flow towards the by-product collection wells as described in this invention, the spatial distribution of residual sand-coke is more uniform, shown as a layer labeled S-C in FIGS. 4 and 7.

Once a significant layer of sand-coke has been established by operations identified and described hereinabove as Phase I of the processes, and as controlled by the duration of the initial pyrolysis period, air or oxygen may be injected, as a second phase, or Phase II of the process of the present invention, via the heating duct arrays, to ignite that coke and thereby utilize heat therefrom to supply an increment of the heat energy input to the tar sand formation so as to favorably impact the overall process economics. The addition, in Phase II, as illustrated in FIG. 7, of a combustion-supporting gas is preferably accomplished by adjusting the composition of the heating gases to include an air flow as illustrated by arrows A in FIG. 7, as necessary in those cases where a primary form of heating is via a discharge of hot gas into the heating ducts 41, or into the gas burners 42 placed within the heating ducts 41. In those cases where, in lieu of burners 42, electrical heaters, not shown, are placed within the heating ducts 41, addition of the combustion supporting gas, preferably in air flow, would be accomplished by injecting said gases into the heating ducts.

As illustrated in FIG. 7, deep collection wells 43 that are completed adjacent to line source heating ducts 41, will be surrounded with a coke blanket build up, identified as S-C. Such sand-coke will be characterized by high lateral and vertical permeability to liquids and gas. To burn, as described, that coke blanket, operation of line source heaters 42 will be temporarily suspended, and the above-described oxygen-containing gas flow, such as air, will be passed thereto. With the introduction of the air flow thereto, by virtue of the prior extraction of carbonaceous material, the coke will ignite and continue to burn as long as the air flow is maintained. The burning of the sand-coke blanket results in generation of sufficient heat to drive the forced convective heat transfer system and the pyrolysis of virgin bitumen. The by-products of the bitumen pyrolysis are collected by the shallow wells 44 completed in the upper one-third (⅓) of the tar sand formation, and the pressure gradients imposed by operation of these shallow collection wells will help to drive the convective heat transfer system. In the basal portion of the tar sand formations, a high permeability clean sand zone will therefore grow both laterally and upward as the coke is combusted the breakthrough of injected air to any collection well indicating a combustion of that coke layer and signaling a discontinuance of the air flow to avoid combustion of the bitumen. Thereafter, a subsequent reinitiation of Phase I processing will result in efficient reestablishment of the forced convective heat transfer system in part due to the presence of the clean sand zone. The Phase I/Phase II sequencing can be repeated as necessary until the desired level of carbonaceous material pyrolytic conversion and recovery of retorted by-products has been achieved.

The concepts disclosed herein describe the present invention in the context of pyrolysis of carbonaceous material contained within a typical tar sand formation and include provisions for simultaneous recovery of retorting liquid and gaseous by-products and immediate use of recovered non-condensible gases and make-up heating gas. Additionally, the concept of operation of conventional stationary horizontal to near horizontal or inclined line source heaters within a subterranean formation to the establishment of a forced-convective heat transfer system, may also be applied and practiced with good effect within other carbonaceous material bearing formation such as in oil shale formations and so the present disclosure should not be taken as limited to in-situ retorting of tar sands only. Thereafter, while a preferred method of in-situ retorting of carbonaceous material for recovery of organic liquids and gases has been shown and described herein, it should be understood that the present disclosure is made by way of example only and that variations are possible without departing from the subject matter coming within the scope of the following claims, which claims we gard as our invention.

What is claimed is:

1. A method of in-situ retorting of carbonaceous material for recovery of organic liquids and gases comprising the steps of, in a carbonaceous material bearing formation forming heating ducts within a basal section thereof that connect to ground surface;

operating heating devices in said ducts to deliver a controlled heat into the formation to create a zone of pyrolysis that extends into the formation from the heating ducts without (causing) igniting the virgin bitumen (of formation to burn);

drawing and collecting through collection wells carbonaceous liquids and condensible and non-condensible gases cracked from the bitumen at the zone of pyrolysis interface;

injecting a combustion supporting gas flow through said heating ducts into a coke layer that (results) has resulted from the thermal cracking of the (birumen, burning that) bitumen, the presence of which combustion supporting gas causes ignition of that hot coke, the coke then burning as a source of heat energy to the zone of pyrolysis;

terminating the combustion supporting gas flow; and restoring operation of the heating devices to deliver controlled heat into the formation.

2. A method as recited in claim 1 wherein, the heating devices receive a combustible gas that is burned therein.

3. A method as recited in claim 2 further including, mixing the non-condensible gas drawn and collected with the combustible gas going to the heating devices.

4. A method as recited in claim 1, wherein, the heating ducts are formed parallel to the dip of the formation from an outcrop thereof.

5. A method as recited in claim 1, wherein the heating ducts are constructed to radiate outwardly in in-seam drafts from vertical shafts constructed by mining methods.

6. A method as recited in claim 1, wherein, the heating ducts are directionally drilled well bores eminating from a control drilling pad.

7. A method as recited in claim 1 wherein the collection wells are formed as, deep wells (and) that extend from the surface into a lower one-third of the carbonaceous material bearing formation; and shallow wells (are formed from the surface to) that extend from the surface into an upper one-third of the carbonaceous material bearing (information) formation.

8. A method as recited in claim 7, further including, locating the deep colection wells immediately adjacent to the heating ducts.

9. A method as recited in claim 1, further including, burning the collected non-condensible gases as a source of heat energy to the heating devices.

10. A method as recited in claim 1, wherein the combustion supporting gas is air.

11. A method as recited in claim 1, wherein the combustion supporting gas is oxygen.

* * * * *